US012208486B1

(12) United States Patent
Nelson et al.

(10) Patent No.: US 12,208,486 B1
(45) Date of Patent: Jan. 28, 2025

(54) SECURE GRINDER BLADE AND TAPERED TOOL—SIDE LOCKING HUB FOR FLUSH CUTTING CONCRETE

(71) Applicants: Daniel Nelson, Morgan, UT (US); Heather Smith Nelson, Morgan, UT (US)

(72) Inventors: Daniel Nelson, Morgan, UT (US); Heather Smith Nelson, Morgan, UT (US)

( * ) Notice: Subject to any disclaimer, the term of this patent is extended or adjusted under 35 U.S.C. 154(b) by 0 days.

(21) Appl. No.: 18/465,489

(22) Filed: Sep. 12, 2023

(51) Int. Cl.

| | |
|---|---|
| ***B24D 7/02*** | (2006.01) |
| ***B24B 23/00*** | (2006.01) |
| ***B24B 23/02*** | (2006.01) |
| ***B24B 27/08*** | (2006.01) |
| ***B24B 41/047*** | (2006.01) |
| ***B24B 45/00*** | (2006.01) |
| ***B24D 7/16*** | (2006.01) |

(52) U.S. Cl.
CPC ..... *B24B 41/047* (2013.01); *B24B 23/005* (2013.01); *B24B 23/022* (2013.01); *B24B 27/08* (2013.01); *B24B 45/006* (2013.01); *B24D 7/02* (2013.01); *B24D 7/16* (2013.01); *B24D 2201/00* (2013.01)

(58) Field of Classification Search
CPC .. B24B 7/18; B24B 7/22; B24B 7/224; B24B 23/005; B24B 23/02; B24B 23/022; B24B 23/028; B24B 27/08; B24B 41/047; B24B 41/0475; B24B 45/00; B24B 45/003; B24B 45/006; B24D 7/02; B24D 7/16; B24D 2201/00
USPC ..... 451/353, 359, 548, 911
See application file for complete search history.

(56) References Cited

U.S. PATENT DOCUMENTS

| | | | | | |
|---|---|---|---|---|---|
| 791,791 | A | * | 6/1905 | Hurford | B24B 45/00 451/342 |
| 2,997,819 | A | * | 8/1961 | Schacht | B24D 9/085 451/510 |
| 3,270,467 | A | * | 9/1966 | Block | B24D 7/16 451/514 |
| 3,270,468 | A | * | 9/1966 | Block | B24D 7/16 451/514 |
| 3,436,875 | A | * | 4/1969 | Cheney | B24D 9/085 451/508 |
| 3,742,656 | A | * | 7/1973 | Amos | B24D 9/085 403/379.5 |
| 3,765,130 | A | * | 10/1973 | Block | B24D 13/20 451/510 |

(Continued)

FOREIGN PATENT DOCUMENTS

| | | | |
|---|---|---|---|
| CN | 113492351 | A * | 10/2021 |
| CN | 113997172 | A * | 2/2022 |

(Continued)

*Primary Examiner* — Eileen P Morgan
(74) *Attorney, Agent, or Firm* — Kunzler Bean & Adamson

(57) ABSTRACT

An apparatus may include a grinder blade for flush cutting concrete, the grinder blade comprising: a distal side that defines a flush cutting plane and a proximal side opposite the distal side, and a locking hub receiver section unitarily formed from the grinder blade at a center portion and extending from the grinder blade a proximal direction to receive a locking hub with a plurality of fasteners disposed proximally to the grinder blade to secure the locking hub against the grinder blade.

15 Claims, 8 Drawing Sheets

(56) References Cited

U.S. PATENT DOCUMENTS

| | | | | | |
|---|---|---|---|---|---|
| 4,267,290 | A * | 5/1981 | Sherman | B24D 7/16 | 525/465 |
| 4,637,170 | A * | 1/1987 | Block | B24B 45/006 | 451/342 |
| 5,964,006 | A * | 10/1999 | Holmes | A46B 9/02 | 15/230.19 |
| 6,116,996 | A * | 9/2000 | Yanase | B24B 23/02 | 451/508 |
| 6,312,325 | B1 * | 11/2001 | Van Osenbruggen | B24D 7/10 | 451/449 |
| 6,523,214 | B1 * | 2/2003 | Kaiser | B24B 45/006 | 451/515 |
| 8,839,778 | B2 * | 9/2014 | South | B28D 1/04 | 125/25 |
| 11,518,001 | B2 * | 12/2022 | Zulauf | B24D 11/02 | |
| 2008/0171498 | A1 * | 7/2008 | Woods | B24B 45/003 | 451/511 |
| 2019/0054615 | A1 * | 2/2019 | Ulliman | B25J 9/106 | |
| 2019/0255678 | A1 * | 8/2019 | Zulauf | B24D 11/02 | |
| 2022/0402110 | A1 * | 12/2022 | Koschel | B24B 23/028 | |
| 2023/0405760 | A1 * | 12/2023 | Beierman | B24D 7/16 | |

FOREIGN PATENT DOCUMENTS

| | | | | |
|---|---|---|---|---|
| EP | 514221 | A2 * | 11/1992 | B24B 45/006 |
| GB | 2333256 | A * | 7/1999 | B24B 23/02 |

* cited by examiner

SECURE GRINDER BLADE AND TAPERED TOOL—SIDE LOCKING HUB FOR FLUSH CUTTING CONCRETE

FIELD

This invention relates to tools for grinding and cutting concrete and more particularly relates to an apparatus, system and method that includes a secure grinder blade and a tapered tool-side locking hub for flush cutting concrete.

BACKGROUND

Handheld grinders can be used for grinding or cutting concrete. Certain grinder blades exist for flush cut grinding and/or cutting of concrete or other similar solid materials. Some grinder blades are cupped and can be fastened to a spindle of an angle grinder using a threaded nut and one or more washers or flanges. Some flush cut grinder blades can be fastened to spindle of an angle grinder using a threaded flange on the tool-side of the grinder that threads onto the spindle and multiple flathead fasteners that fasten from a grinding surface side of the blade (opposite the tool-side of the blade) to press the blade tightly against the threaded flange. However, existing flush cut grinder blades may inefficient or may become dangerous through continuous use.

SUMMARY

An apparatus comprising a grinder blade and a tapered tool-side locking hub for flush cutting concrete is disclosed. A system and method of manufacturing the grinder blade and a tapered tool-side locking hub for flush cutting concrete is disclosed.

In various aspects, the techniques described herein relate to an apparatus including: a grinder blade for flush cutting concrete, the grinder blade including: a distal side that defines a flush cutting plane and a proximal side that defines a tool-side plane opposite the distal side, and a locking hub receiver section unitarily formed from the grinder blade at a center portion and extending from the grinder blade a proximal direction to receive a locking hub with a plurality of fasteners disposed proximally to the tool-side plane to secure the locking hub against the grinder blade.

In certain aspects, the techniques described herein relate to an apparatus, further including the locking hub, wherein the locking hub includes: a three dimensional solid with a proximal locking hub surface configured to directly receive a spindle of a grinder; and a geometry that conforms to the locking hub receiver section, wherein the locking hub is configured to be secured against the locking hub receiver section of the grinder blade by a plurality of fasteners disposed proximally of the tool-side plane.

In some aspects, the techniques described herein relate to an apparatus, wherein the plurality of fasteners include non-countersunk machine screws.

In various aspects, the techniques described herein relate to an apparatus, wherein heads of the non-countersunk machine screws are selected from star drive, square drive, Phillips drive, and hex drive.

In certain aspects, the techniques described herein relate to an apparatus, further including a plurality of tabs that are unitarily formed from the grinder blade at a center portion and angled in the proximal direction at an acute angle relative to the tool-side plane.

In some aspects, the techniques described herein relate to an apparatus, further including one or more fastener holes in the plurality of tabs through which the plurality of fasteners disposed proximally of the tool-side plane pass to secure one or more tabs of the locking hub against the grinder blade.

In various aspects, the techniques described herein relate to an apparatus, wherein the geometry of the locking hub includes a polygonal frustum, wherein the polygonal frustum of the locking hub is derived from a regular polygon, the regular polygon including a number of sides ranging from 3 to 8, inclusive.

In certain aspects, the techniques described herein relate to an apparatus, wherein the locking hub includes a locking hub base for the polygonal frustum wherein a geometry of the locking hub base includes a non-tapered polygonal extrusion extending from a distal end of the polygonal frustum.

In some aspects, the techniques described herein relate to an apparatus, wherein the geometry of the locking hub includes a four-sided frustum.

In various aspects, the techniques described herein relate to an apparatus, a taper angle of the polygonal frustum relative to a centerline axis of the polygonal frustum is from about 20 degrees to about 70 degrees.

In certain aspects, the techniques described herein relate to an apparatus, wherein the grinder blade includes one or more cutting surfaces at an outer perimeter including diamond particles.

In some aspects, the techniques described herein relate to an apparatus, wherein the grinder blade includes a segmented rim.

In various aspects, the techniques described herein relate to an apparatus, wherein the grinder blade includes a plurality of grinding segments including diamond particles on a distal surface of the plurality of grinding segments.

In certain aspects, the techniques described herein relate to an apparatus, wherein the plurality of grinding segments are angled in a turbo pattern.

In some aspects, the the method 800 continues and includes providing a grinder blade with a distal side that defines a flush cutting plane and a proximal side that defines a tool-side plane opposite the distal side; and forming a locking hub receiver section extending proximally from a center portion of the grinder blade and configured to receive a locking hub from the distal side and a plurality of fasteners disposed proximally to the tool-side plane to secure the locking hub against the grinder blade.

In various aspects, the techniques described herein relate to a method, further including selecting a geometry for the locking hub receiver section that conforms to a polygonal frustum derived from a regular polygon with from three to eight sides.

In certain aspects, the techniques described herein relate to a method, further including creating a plurality of slits at a center portion of the grinder blade to form a plurality of tabs corresponding to a proximal tapered portion of the locking hub receiver section.

In some aspects, the techniques described herein relate to a method, further including creating holes in two or more of the plurality of tabs to receive fasteners for tightening two or more of the plurality of tabs against the locking hub.

In various aspects, the techniques described herein relate to a method, further including bending the plurality of tabs to a tab angle that is configured to substantially conform to a taper angle of the locking hub.

In certain aspects, the techniques described herein relate to a system including: a grinder; a grinder blade for flush cutting concrete, the grinder blade including: a distal side that defines a flush cutting plane and a proximal side that defines a tool-side plane opposite the distal side, and a locking hub receiver section unitarily formed from the grinder blade at a center portion and extending from the grinder blade a proximal direction to receive a locking hub with a plurality of fasteners disposed proximally to the grinder blade to secure the locking hub against the grinder blade; and a locking hub including: a three dimensional solid with a proximal locking hub surface configured to directly receive a spindle of the grinder; and a geometry that conforms to the locking hub receiver section, wherein the locking hub is configured to be secured against the locking hub receiver section of the grinder blade by a plurality of fasteners disposed proximally of the tool-side plane.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
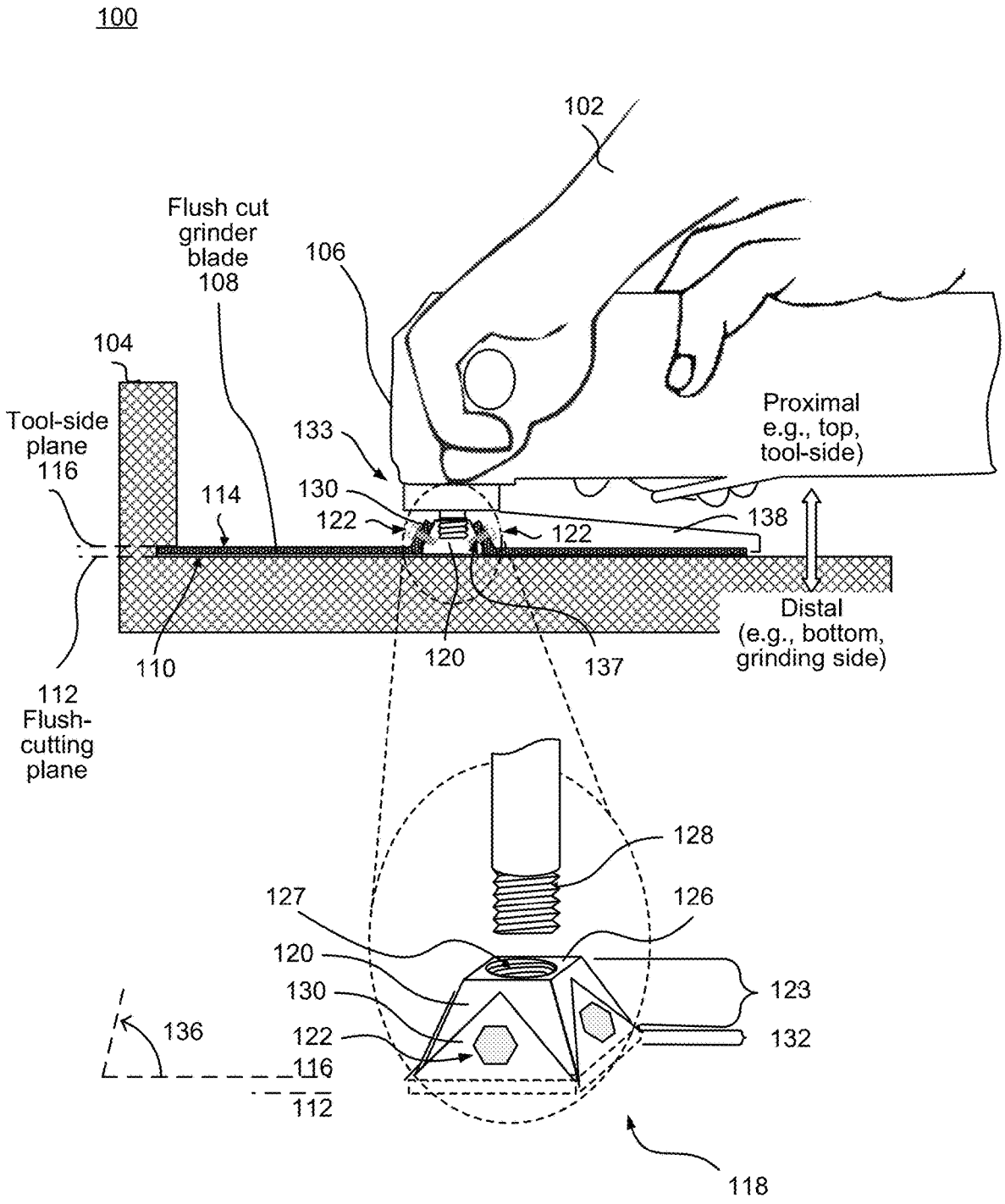
FIG. 1 depicts a schematic block diagram illustrating a system for flush cutting or grinding concrete, according to one or more examples of the disclosure.

Reference throughout this specification to "some implementations," "various implementations," "certain implementations," or similar language means that a particular feature, structure, or characteristic described in connection with the description is included in at least one implementation and may be included in some or all implementations. Thus, appearances of the phrases "in one implementation," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more examples or implementations. In the following description, numerous specific details are provided, such as examples of various implementations. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Unless otherwise clear from context, in a specific figure of the drawings, the same components are represented by the same reference numbers, and in a specific figure or in different figures, components with similar structures or functions are represented by the similar reference numbers (e.g., with a different starting digit or with a letter appended as a suffix).

The size and thickness of components shown in the present disclosure does not limit the size and thickness of each component. In order to make the drawings clearer, the thickness of certain components may be modified in some places in the drawings.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Aspects of the present disclosure are described herein with reference to flowchart illustrations and/or block diagrams of methods, apparatus (systems).

The schematic flowchart diagrams and/or schematic block diagrams in the Figures illustrate the architecture, functionality, and operation of possible implementations of apparatuses, systems, and methods.

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment.

As used herein, a list with a conjunction of "and/or" includes any single item in the list or a combination of items in the list. For example, a list of A, B and/or C includes only A, only B, only C, a combination of A and B, a combination of B and C, a combination of A and C or a combination of A, B and C. As used herein, a list using the terminology "one or more of" includes any single item in the list or a combination of items in the list. For example, one or more of A, B and C includes only A, only B, only C, a combination of A and B, a combination of B and C, a combination of A and C or a combination of A, B and C. As used herein, a list using the terminology "one of" includes one and only one of any single item in the list. For example, "one of A, B and C" includes only A, only B or only C and excludes combinations of A, B and C. As used herein, "a member selected from the group consisting of A, B, and C," includes one and only one of A, B, or C, and excludes combinations of A, B, and C. As used herein, "a member selected from the group consisting of A, B, and C and combinations thereof" includes only A, only B, only C, a combination of A and B, a combination of B and C, a combination of A and C or a combination of A, B and C.

As used herein, the term "about" can refer to within 10% of a stated value including those for a measurement, characteristic, parameter or property and more preferably within 5% of such a stated value. As used herein, the term "substantially" when applied to a structure or functionality of a feature can mean materially, to a great extent, or nearly entirely but not necessarily completely or perfectly and is used to convey that a degree of variation in the feature is allowed while still ensuring that the core functionality or characteristic of the feature is preserved.

Introduction

Handheld angle grinders are commonly used in construction and manufacturing industries for cutting, grinding, and polishing. As will be described more with respect to FIGS. 2A-2E, the inventor of the subject matter of the disclosure has recognized that certain risks may be presented by existing grinder blades and mounting systems for flush cutting concrete.

Overview

The present disclosure relates to a secure grinder blade and tapered tool-side locking hub for flush cutting concrete. The apparatuses, methods, and systems disclosed herein represent a significant improvement in concrete cutting technology by providing a flush cutting concrete blade with a tapered tool-side locking hub that ensures that the blade is securely locked in place, providing a stable cutting surface for flush cutting concrete without the various inefficiencies and risks of injury present in existing systems. The secure grinder blade and tapered tool-side locking hub can be used with a handheld angle grinder and a safety guards to provide a safer and more efficient method of flush cutting concrete.

FIG. 1 depicts a schematic block diagram illustrating a system 100 that enables a user 102 to perform flush cutting or grinding on a section or piece of concrete 104, according to one or more examples of the disclosure. The section of concrete 104 depicted in FIG. 1 includes a first section depicted as a vertical wall of the left hand side of the concrete 104 and a second section of the concrete 104 depicted as a floor.

Flush cutting or grinding refers to the act of making a cut or grind that is aligned or level with a particular surface. In other words, the cut or grind is made in such a way that the cut or ground surface and the adjoining surface are "flush" or smooth with each other, without any protrusion or indentation. This is often important when you want a seamless or smooth transition between the cut material and an adjacent surface.

In construction, especially involving concrete or masonry, flush cuts can be used to cleanly remove excess material or make adjustments right up to the edge of walls, columns, or other fixtures. An example of flush cutting is depicted in FIG. 1 where perpendicular sections of concrete are adjoined e.g., a vertical wall section is depicted as perpendicularly adjoined to a floor section.

The system 100 includes a grinder 106 such as an angle grinder. The grinder 106 depicted is intended to illustrate a large angle grinder, such as for example, a 7-inch or 9-inch angle grinder. Large angle grinders typically have lower rotational speeds and higher torque than smaller 4.5-inch or 5-inch angle grinders. Large angle grinders are generally used for more heavy-duty tasks, requiring higher torque to remove more material or cut through denser materials such as concrete. Higher torque often goes hand-in-hand with lower RPMs. Lower RPMs can also make larger grinders easier to control during heavy-duty tasks, as they are less likely to "run away" or become difficult to manage.

The system 100 includes a grinder blade 108 with a bottom or distal side 110 that defines a flush cutting plane 112 and a top or proximal side 114 that defines a tool-side plane 116 opposite the distal side 110. As a described in more detail below with respect to FIG. 5A, in some examples, the grinder blade 108 includes a core material comprising a hard metal or a hard metal alloy for flush cutting concrete. As further illustrated in FIG. 1, the grinder blade 108 includes a top side 114 configured to face a grinder 106 to which the grinder blade 108 is attached. An outer edge of the grinder blade 108 enables the grinder blade 108 to make a perpendicular cut into a surface of a first section of concrete 104 (in FIG. 1, the grinder blade 108 is depicted as making a perpendicular cut into the vertical wall). As the grinder blade 108 make a perpendicular cut into the first section (e.g., the vertical wall), the depth of the cut may extend up to a radial depth of the grinder blade 108 that is proximate to a locking hub receiver section 118 on the top side of the grinder blade at a center portion of the grinder blade. As depicted in FIG. 1, the perpendicular cut is perpendicular relative to the surface of the first section of concrete (e.g., the grinder blade is operable to make a horizontal cut in the vertical wall). A bottom side 110 of the grinder blade 108 makes flush contact with a second section of concrete 104 which is depicted as a horizontal floor that is perpendicularly adjoined to the first section of concrete concurrently with the outer edge making a perpendicular cut into the first section of concrete. The use of the terms "top" and "bottom" is not meant to be limiting of the orientation of any element described herein. For the sake of the discussion herein, generally, the terms "top" or "upper" and "bottom" or "lower" are used, with the understanding that these terms are equivalent to other terms such as "proximal" and "distal" depending on the orientation of the described element. With the grinder 106 oriented as depicted in FIG. 1, the term "proximal" could be thought of as an upper or top and the term "distal" could be thought of as lower or bottom.

Because a grinder such as the grinder 106 may be oriented in any direction, the term "distal" may also be referred to as in a direction toward a grinding side of the grinder blade 108 and away from the tool e.g., the grinder 106 and the term "proximal" may be referred to as in a direction toward the tool-side of the grinder blade 108.

In various implementations, the grinder blade 108 includes a locking hub receiver section 118 unitarily formed from the grinder blade 108 at a center portion 133 and extending from the grinder blade 108 in a proximal direction to receive a locking hub 120 with a plurality of fasteners 122 disposed proximally to the tool-side plane 116 to secure the locking hub 120 against the grinder blade 108. Forming the locking hub receiver section 118 unitarily from the grinder blade 108 beneficially ensures that the same material used in the core of the grinder blade is used to form the locking hub receiver section 118.

In one or more implementations, the locking hub 120 includes a solid geometric form that substantially conforms to the locking hub receiver section 118. In such implementations, the locking hub 120 also includes a spindle engaging bore 127 (e.g., a threaded hole) that opens at a proximal plane 126 of the locking hub 120. The locking hub 120 further includes, in various implementations, two or more fastener engaging bores 137 on tapered side portions of the locking hub 120 that are configured to be secured against the locking hub receiver section of the grinder blade by a plurality of fasteners 122 disposed proximally of the tool-side plane 116 that is selected to fit snugly into the locking hub receiver section 118.

In such implementations, the spindle engaging bore 127 (e.g., a threaded hole) is configured to be tightened on to the spindle 128 of the grinder 106 such that during operation of the grinder 106 the rotational forces do not loosen the locking hub 120 that is fastened to the grinder blade 108 by fasteners 122 disposed proximally of the tool-side plane 116 which pass through multiple tabs 130 of the locking hub receiver section 118 and into two or more fastener engaging bores 137.

As depicted in greater detail in the magnified inset at bottom of FIG. 1, the locking hub receiver section 118 includes multiple tabs 130 that are unitarily formed from the grinder blade 108 at a center portion 133 and are angled in the proximal direction at an acute angle 136 relative to the tool-side plane 116. Further details about the geometry 123 of the locking hub 120 and the acute angle 136 at which the multiple tabs 130 are angled are provided with respect to FIG. 4A. In various implementations, the locking hub 120 also a locking hub base 132 that is non-tapered and extends from a distal end of the geometry (e.g., a polygonal frustum) of the locking hub 120.

As previously mentioned with respect to the locking hub receiver section 118 of the grinder blade 108, in various implementations, the locking hub 120 is likewise configured to be secured against the locking hub receiver section 118 of the grinder blade 108 by a plurality of fasteners 122 disposed proximally of the tool-side plane 116. In other words, the locking hub 120 may be inserted from a distal side on 110 of the grinder blade 108 but is secured against the locking hub receiver section 118 with fasteners that are disposed proximally to the tool-side plane 116. Further details about heads of the fasteners 122 are described with respect to FIGS. 3C-3E.

In some implementations, the system 100 includes a blade guard 138 that attaches to the grinder 106. The blade guard 138 serves multiple essential functions that enhance the overall efficiency and safety of the system 100. When attached to the grinder 106, the blade guard 138 acts as a physical barrier that contains debris, dust, and sparks generated during the cutting or grinding process, thereby reducing potential hazards. This is particularly beneficial when working with materials like concrete, which can generate substantial amounts of dust and fragments. Moreover, the blade guard 138 aids in channeling the generated debris away from the operator, minimizing the risk of injury. The blade guard 138 is also designed to work seamlessly with the secure grinder blade 108, including its tapered tool-side locking hub 120, to maintain an optimal distance and alignment between the grinder blade 108 and the surface being worked on. This ensures a more controlled, precise, and efficient flush cutting or grinding operation. The blade guard 138 can also include markings or guides that assist the operator in achieving the desired depth and angle of the cut, further enhancing the utility and functionality of the system 100. Therefore, the inclusion of the blade guard 138 provides an integrated solution that maximizes both the performance and safety aspects of flush cutting or grinding concrete 104 with the grinder 106 and secure grinder blade 108.

The tool-side fastening approach developed by the inventors of the present subject matter represent a significant improvement over existing approaches in which countersunk heads of fasteners such as machine screws are typically disposed and fastened distally of the tool-side plane which subjects them to grinding where, vibrations, stresses and mechanical limitations that result in decreased reliability and increase safety risk to the user 102 as explained in more detail with respect to FIGS. 2A-2E in the following sections.

Figure 2A:
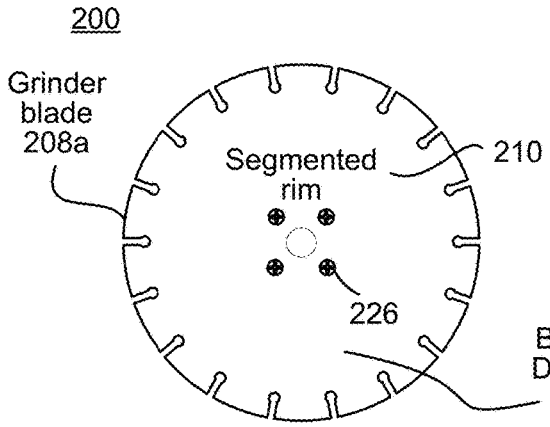
Prior Art FIG. 2A
FIG. 2A depicts a bottom or distal side plan view of a grinder blade with a segmented rim for flush cutting concrete that uses fasteners fastened from the distal side of the grinder blade.

FIG. 2A depicts a bottom or distal side 210 plan view 200 of a grinder blade 208*a* with a segmented rim for flush cutting concrete that uses fasteners 222 fastened from the distal side 210 for fastening the grinder blade 208*a* to a spindle mounting flange 224 disposed proximally of a tool-side plane 216 defined by a proximal side 214 opposite the distal side 210.

Figure 2B:
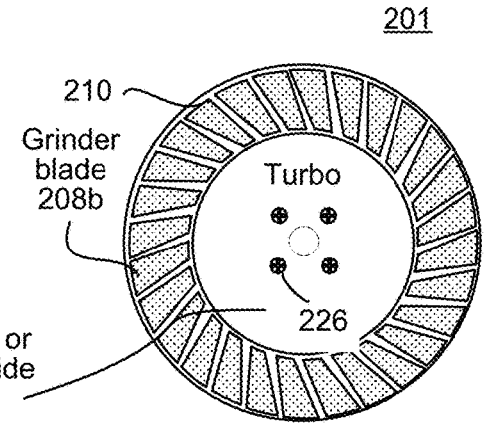
Prior Art FIG. 2B
FIG. 2B depicts a bottom or distal side plan view of a grinder blade with diamond segments arranged in a turbo pattern where fasteners are fastened from the distal side of the grinder blade.

FIG. 2B depicts a bottom or distal side plan view 201 of a grinder blade 208*b* with diamond segments arranged in a turbo pattern where the fasteners 222 are fastened from the bottom or distal side 210 of the grinder blade 208*b* to a spindle mounting flange 224 disposed proximally of a tool-side plane 216 defined by a top or proximal side 214 opposite the bottom or distal side 210. In such grinder blades, the diamond segments are arranged on the bottom or distal side 210 of the grinder blade 208*b*. A grinder blade 208*b* with a turbo pattern may experience more force perpendicular to the flush cutting plane 212 due to the grinder 106 being pressed down or in the distal direction by a user and/or by the weight of the grinder 106.

Figure 2C:
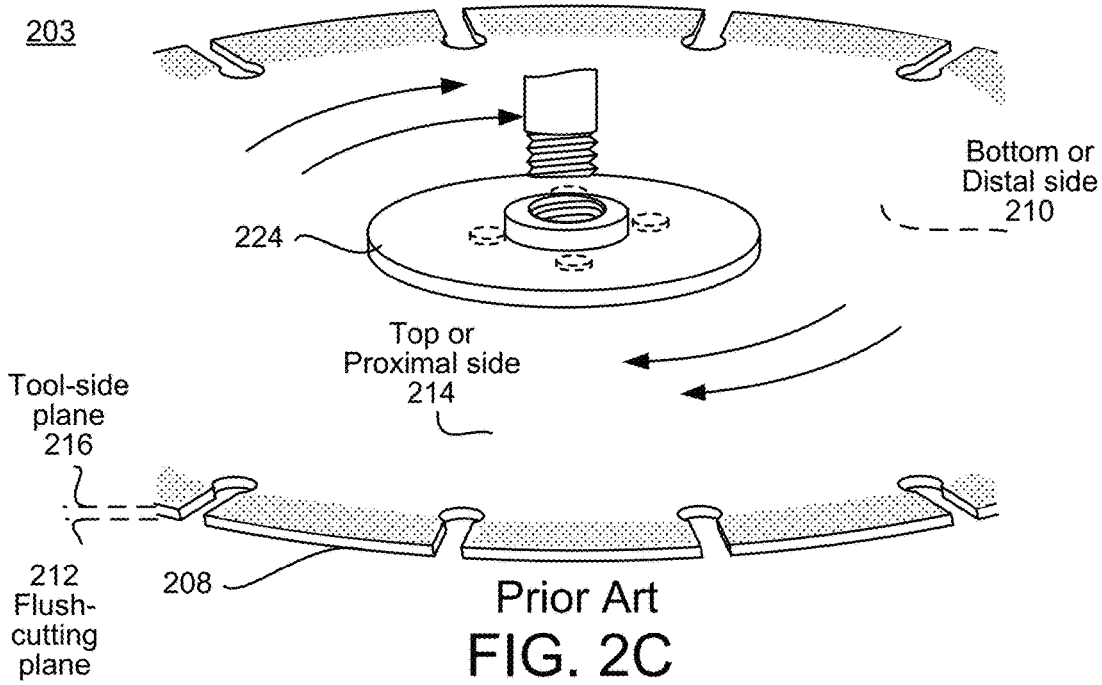
Prior Art FIG. 2C
FIG. 2C depicts a perspective tool-mounting side view of a representative example of grinder blade that uses fasteners on a grinding side of the axial blade plane for fastening the grinder blade to a spindle mounting flange on a tool-mounting side of the grinder blade.

FIG. 2C depicts a perspective top or proximal side view 203 of a representative example of grinder blade 208 that uses fasteners 222 which are fastened from the distal side of the grinder blade 208 to a spindle mounting flange 224 which is disposed proximally of the tool-side plane 216 of the grinder blade 208.

Although using cupped grinding wheels for flush cutting concrete can be done, the diameter of the cup section makes a large center portion of the blade unavailable for flush cutting making it hard to flush cut in close quarters making such an approach less than optimal.

Other existing approaches for mounting flush cut grinder blades to angle grinder available are grinder blades 208 that use from four to six fasteners 222 in the form of countersunk machine screws that are put through the grinder blade 208 from the bottom side or distal side of the flush cut grinder blade 208 so that the fasteners 222 may be tightened flush with the flush cutting plane 212. However, the heads 226 of the fasteners 222 (that are countersunk machine screws) are very thin at the outer rim and if even the screws are even slightly loose, mis-threaded, or worn, when flush cutting or grinding concrete with a large high torque grinder 106, the results can be potentially injurious or even fatal.

Furthermore, in comparison to other types of machine screws such as pan head or hex head machine screws, countersunk machine screws cannot be tightened very tightly against the blade because of the relatively small available center area for inserting a driving tool such as a hex head or Torx® driver or screwdriver due to the tapering shape of the countersunk head 226. Moreover, unlike other types of machine screws, is difficult to use countersunk machine screws with split ring lock washers, tooth lock washers or other tightening mechanisms that exert a spring force because these types of mechanisms would not allow the machine screws to be screwed down flush with the flush cutting plane 212.

Figure 2D:
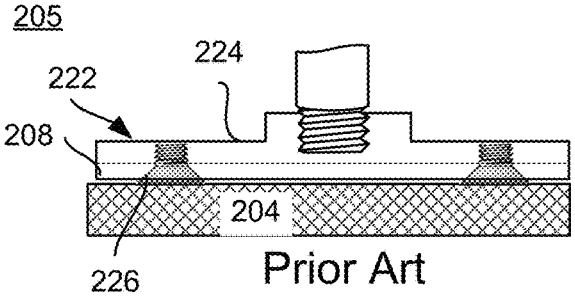
Prior Art FIG. 2D
FIG. 2D depicts a cross-sectional view of a grinder blade with unworn heads of fasteners fastened from the bottom or distal side of the grinder blade.

Additionally, as the existing flush cut grinder blade 208 with the heads 226 of the fasteners 222 being disposed distally of the tool-side plane 216 is used for flush cut grinding, the heads 226 may start out in good condition as depicted in FIG. 2D.

FIG. 2D depicts a cross-sectional view 205 of a grinder blade 208 with unworn heads 226 of fasteners 222 fastened from the bottom or distal side of the grinder blade 208 to a spindle mounting flange 224 on a top or proximal side of the grinder blade 208. As can be seen, the heads 226 of the fasteners 222 start out in good condition even though they are countersunk machine screw heads. However, starting out in good condition does not mean that problems including safety risks cannot occur.

Figure 2E:
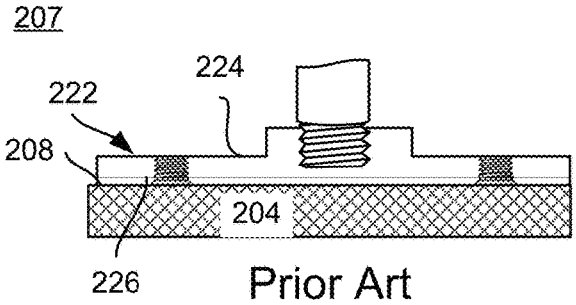
Prior Art FIG. 2E
FIG. 2E depicts a cross-sectional view of a grinder blade with ground down heads of fasteners fastened from the bottom or distal side of the grinder blade.

FIG. 2E depicts a cross-sectional view 207 of a grinder blade 208 with ground down heads 226 of fasteners 222 fastened from the bottom or distal side of the grinder blade 208 to a spindle mounting flange 224 on a top or proximal side of the grinder blade 208. This type of wear can present significant problems of injury risk and inefficiency.

As flush cut cutting or grinding of hard material such as concrete 204 occurs, the heads 226 of the fasteners 222 are ground or worn down making them dirty and difficult to tighten and potentially uneven or the heads 226 of the fasteners 222 may be completely off potentially causing the grinder blade 208 to break, disintegrate, fly off, and damage property and potentially injure the user, which in some cases may result in fatal injuries.

As of the filing date of the present disclosure, one flush cut diamond blade vendor prominently displays a warning such as the following on its website: "Caution: flush cut diamond blades must be used with extreme care and caution. They are for experienced tradespeople only. Always check before use, or if used in extended operation that countersunk screws are tight and are not damaged or worn and that the blade flange is not worn or damaged and that the blade runs true with no vibration."

Furthermore, even if care is taken not to use the grinder blade 208 beyond the point when the fasteners 222 are no longer safely able to be tightened, so that by no longer using the grinder blade 208 there is less risk of injury or property damage, the existing approach still results in discarding the grinder blade 208 based on the wear out time of the fasteners 222 rather than the wear out time of the grinder blade 208 itself. This existing approach can be economically and environmentally inefficient and wasteful.

Accordingly, the inventor of the subject matter of the disclosure has developed the apparatuses, systems, and methods for flush cutting concrete using the secure grinder blades 108,308*a*, 308*b* and tapered tool-side locking hub 120,320 described with respect to FIG. 1, and FIGS. 3A-3E, which provide numerous safety, reliability, and efficiency improvements over existing flush cut grinder blades, mounting systems, and methods.

Figure 3A:
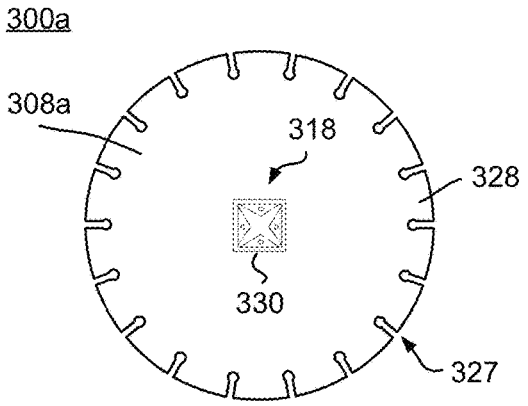
FIG. 3A depicts a bottom or distal side plan view of an apparatus for flush cutting concrete including a grinder blade with a segmented rim and a locking hub receiving section.

FIG. 3A depicts a bottom or distal side 314 plan view of an apparatus 300*a* for flush cutting concrete 304 including a grinder blade 308*a* with a segmented rim and a locking hub receiver section 318. In various implementations, the grinder blade 308 comprises a segmented rim 327. In some implementations, the grinder blade 308 includes one or more cutting surfaces at an outer perimeter comprising diamond particles.

In certain implementations, the grinder blade 308*a* comprises a plurality of diamond grinding regions 328. For example, a segmented rim diamond grinder blade such as grinder blade 308*a* may include diamond grinding regions 328 on both the distal side 310 and the proximal side 314 of the grinder blade 308*a* as well as on the outer edges the grinder blade 308*a*.

Figure 3B:
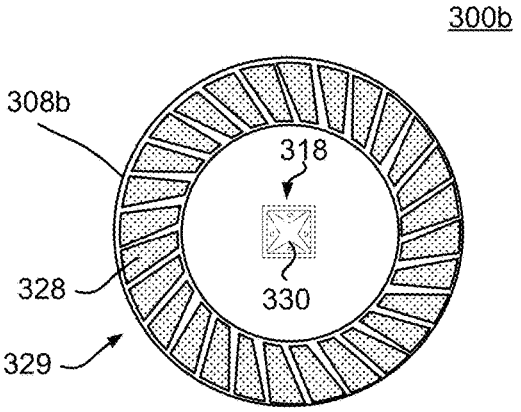
FIG. 3B depicts a distal side plan view of an apparatus for flush cutting concrete including a grinder blade with a segmented rim and a locking hub receiving section.

FIG. 3B depicts a bottom or distal side 310 plan view of an apparatus 300*b* for flush cutting concrete 304 including a grinder blade 308*b* with a turbo rim and a locking hub receiver section 318. It may be noted that in many respects, the grinder blade 308*a* and the grinder blade 308*b* may be formed similarly or even identically with respect to the center portion 333. The grinder blade 308*b* may also include diamond grinding regions 328. In some implementations, the diamond grinding regions 328 are diamond segments 329 angled in a turbo pattern.

In such implementations, the diamond segments 329 are arranged the bottom or distal side 310 of the grinder blade 308*b*. In certain implementations, a grinder blade 308*b* with a turbo pattern may have better reliability even while experiencing more force perpendicular to the flush cutting plane 312 due to the grinder blade 308*b* being pressed down or in the distal direction by a user and/or by the weight of the grinder 106. Accordingly, the solutions provided herein a be particularly beneficial for grinder blades 308*a* with diamond segments 329 angled in a turbo pattern.

Figure 3C:
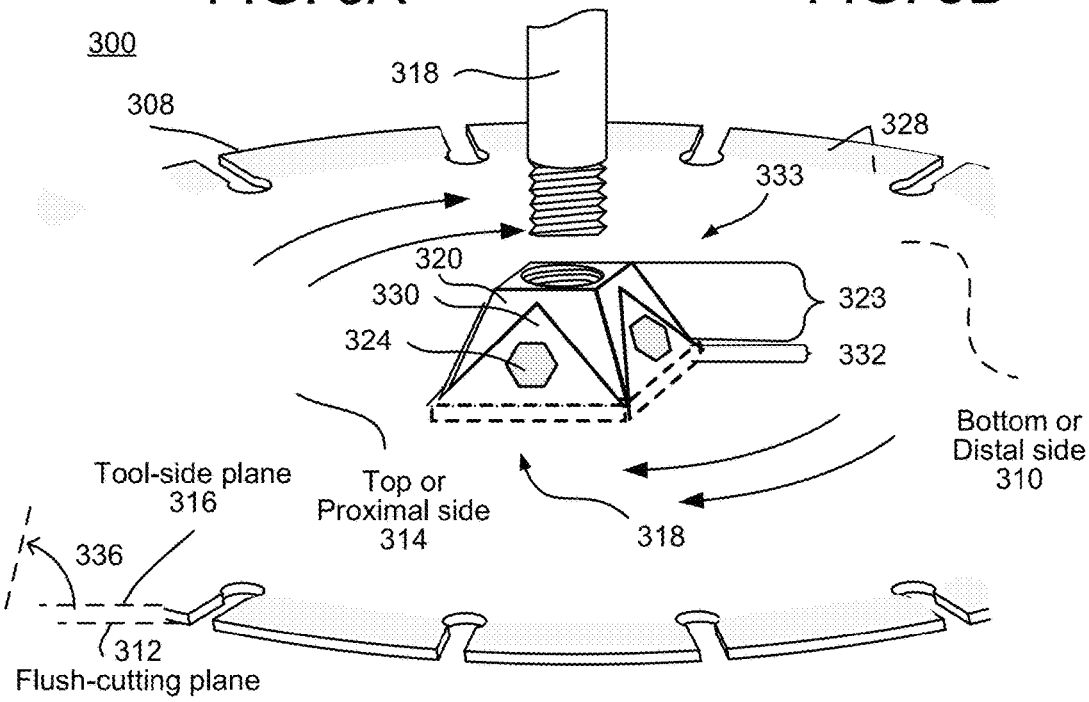
FIG. 3C depicts a top or proximal side perspective view of an apparatus for flush cutting concrete including a grinder blade with fasteners disposed entirely proximal of the tool-side plane that secure a locking hub receiver section to a locking hub, according to one or more examples of the disclosure.

FIG. 3C depicts a top or proximal side perspective view of an apparatus 300 for flush cutting concrete including a grinder blade 308 with fasteners 322 disposed entirely proximal of the tool-side plane 316 that secure a locking hub receiver section 318 to a locking hub 320, according to one or more examples of the disclosure. As depicted in FIG. 3C, the grinder blade 308 includes a bottom or distal side 310 that defines a flush cutting plane 312 and a top or proximal side 314 that defines the tool-side plane 316.

Consistent with the description provided with respect to FIG. 1, depicted in FIG. 3C is a locking hub receiver section 318 that includes multiple tabs 330 that are unitarily formed from the grinder blade 308 at a center portion and are angled in the proximal direction at an acute angle 336 relative to the tool-side plane 316. Further details about the geometry 323 of the locking hub 320 and the acute angle 336 at which the multiple tabs 330 are angled are provided with respect to FIG. 4A. In various implementations, the locking hub 320 includes a locking hub base 332 for the polygonal frustum where a geometry of the locking hub base 332 includes a non-tapered polygonal extrusion extending from a distal end of the polygonal frustum.

The grinder blade 308 is configured to use fasteners 322 disposed proximally of a tool-side plane 316 for securing the grinder blade 308 to a tapered locking hub 320, according to one or more examples of the disclosure.

It may be noted that the entirety of each of the fasteners 322 is disposed proximally of the tool side plane 316 during flush cut grinding or cutting operations which eliminates the risk of the fasteners 322 being ground down or ground off resulting in inefficient blade usage and/or potential breakage or damage with resulting injuries. Visibility of the fasteners 322 disposed proximally of the tool side plane 316 during operations may allow observation of looseness and/or vibration of the fasteners 322.

Moreover, the fasteners 322 being disposed proximally of the tool side plane 316 during fastening and unfastening of the fasteners 322 provides a user with better visibility and accessibility to the fasteners 322 during fastening and unfastening of the grinder blade 308 to the tapered locking hub 320.

Figure 3D:
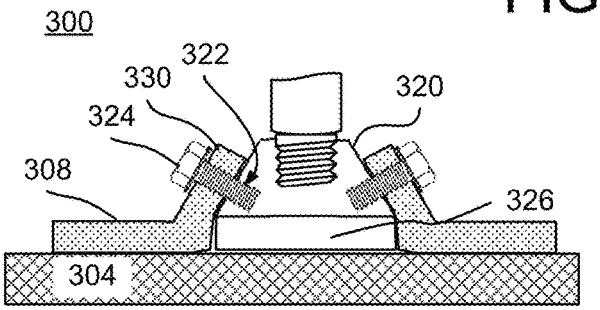
FIG. 3D depicts a cross-sectional view of an apparatus for flush cutting concrete with a grinder blade with unworn fastener heads on fasteners disposed proximally of a tool-side plane for securing the grinder blade to a tapered locking hub, according to one or more examples of the disclosure.
Figure 3E:
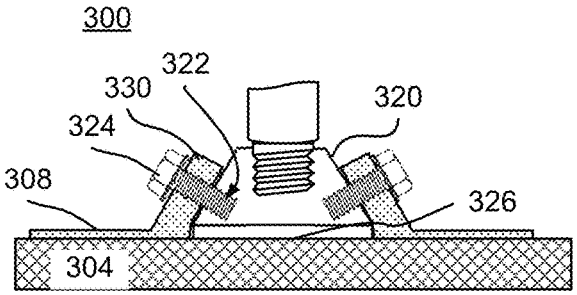
FIG. 3E depicts a cross-sectional view of an apparatus for flush cutting concrete with a partially worn grinder blade and still unworn fastener heads on fasteners disposed proximally of a tool-side plane for securing the grinder blade to a tapered locking hub, according to one or more examples of the disclosure.

FIG. 3D depicts a cross-sectional view of an apparatus 300 for flush cutting concrete 304 with a grinder blade 308 with unworn fastener heads 324 on fasteners disposed proximally of a tool-side plane 316 for securing the grinder blade 308 to a tapered locking hub 320, according to one or more examples of the disclosure. It may be noted that in certain implementations, the fasteners 322 are non-countersunk machine screws or similar fasteners. In certain implementations, the heads 324 of the fasteners 322 are selected from star drive, square drive, Phillips drive, internal hex drive, and external hex drive. For example, the heads 324 depicted in FIGS. 3C-3E are depicted as external hex drive heads with built-in locking teeth that act as a lock washer and facilitate a tight fastening of the tabs 330 to the locking hub 320. Such mechanisms are not available in existing approaches that use machine screws with countersunk heads that are fastened from the bottom or distal side 210 of existing grinder blades 208.

As can be seen, in FIG. 3D, before grinding the concrete 304, the locking hub base 326 is completely unworn as is the grinder blade 308.

FIG. 3E depicts a cross-sectional view of an apparatus 300 for flush cutting concrete 304 with a partially worn grinder blade 308 and still unworn fastener heads 324 on fasteners disposed proximally of a tool-side plane 316 for securing the grinder blade 308 to a tapered locking hub 320, according to one or more examples of the disclosure.

In various implementations, a secure grinder blade 108, 308*a*, 308*b* includes a locking hub receiver section 118, 318 that is configured to receive a tapered tool-side locking hub 120, 320, and the like. In some implementations, the locking hub 120, 320, and the like, includes a geometry that conforms to a polygonal frustum derived from a regular polygon with a varying number of sides (e.g., ranging from 3 to 8).

Referring now to FIGS. 4A-4D, depicted are various implementations of a secure locking hub with different numbers of polygonal sides, particularly focusing on 3-sided, 4-sided, 5-sided, and 6-sided polygonal frustra.

Figure 4A:
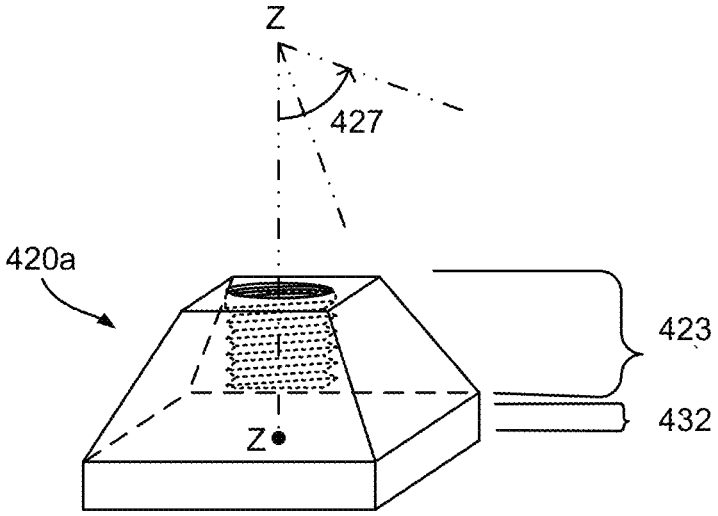
FIG. 4A depicts a perspective view of a tapered locking hub with a geometry that includes a four-sided polygonal frustum and a base, according to one or more examples of the disclosure.

FIG. 4A depicts a perspective view of a tapered locking hub 420*a* with a geometry that includes a four-sided polygonal frustum and a base, according to one or more examples of the disclosure. In certain implementations, a geometry 423 of the locking hub 420*a* includes a four-sided or rectangular frustum and a corresponding base 432.

In some implementations, a taper angle 427 of the polygonal frustum relative to a centerline axis Z-Z of the polygonal frustum is from about 20 degrees to about 70 degrees.

Certain benefits of a selecting a geometry 423 that includes a rectangular frustum are outlined may include the following: a) Stable Mount: The 4-sided geometry 423 can provide a more stable mount by distributing forces evenly across the four sides; b) Efficient Tool Setup: fastening and unfastening a grinder blade 108, 308*a*, 308*b*, from a locking hub 120, 320 with a geometry 423 that is four-sided takes fewer operations and less time than fastening and unfastening from locking hubs with a greater number of sides; and c) Manufacturability: fewer technical manufacturing problems may be encountered with the geometries that are four-sides with geometries that have less or more than four sides. On the other hand, in certain situations geometries 423 that are three-sided, five-sided, and six-sided may also have comparative advantages.

Figure 4B:
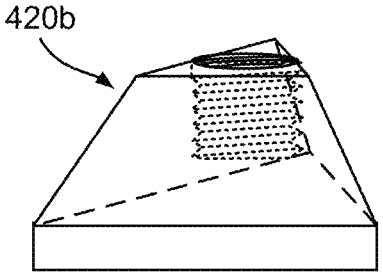
FIG. 4B depicts a perspective view of a tapered locking hub with a geometry that includes a three-sided polygonal frustum, according to one or more examples of the disclosure.

FIG. 4B depicts a perspective view of a tapered locking hub 420*b* with a geometry 423 that includes a three-sided polygonal frustum, according to one or more examples of the disclosure. Selecting a geometry 423 with a three-sided polygonal frustum (also referred to as a triangular frustum) may provide one or more of the following advantages: a) simplicity: fewer sides means fewer fasteners and simpler manufacturing requirements; b) quick alignment: a geometry 423 with three sides may allow easier alignment of the locking hub 120, 320 with the locking hub receiver section 118, 318 due to fewer sides to match up; c) torque resistance: the acute angles in a triangular configuration may offer better resistance to rotational forces.

Figure 4C:
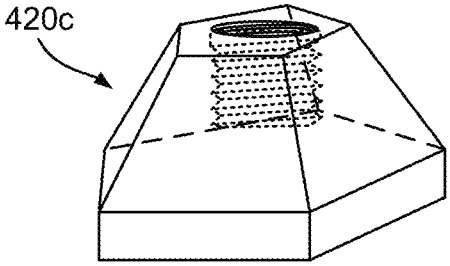
FIG. 4C depicts a perspective view of a tapered locking hub with a geometry that includes a five-sided polygonal frustum, according to one or more examples of the disclosure.

FIG. 4C depicts a perspective view of a tapered locking hub 420*c* with a geometry that includes a five-sided polygonal frustum, according to one or more examples of the disclosure. electing a geometry 423 with a five-sided polygonal frustum (also referred to as a pentagonal frustum) may provide one or more of the following advantages: a) Increased Contact Area: More sides lead to increased surface area for contact, which may offer better grip and less slippage; b) Intermediate Complexity: A balance between the simplicity of 3 and 4-sided designs and the complexity of 6-sided or higher designs, potentially offering a mix of their advantages; c) Aesthetic Variety: A 5-sided geometry 423 may provide aesthetic benefits, which could be attractive for some users.

Figure 4D:
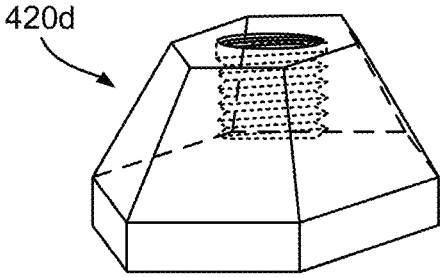
FIG. 4D depicts a perspective view of a tapered locking hub with a geometry that includes a six-sided polygonal frustum, according to one or more examples of the disclosure.

FIG. 4D depicts a perspective view of a tapered locking hub 420*d* with a geometry 423 that includes a six-sided polygonal frustum, according to one or more examples of the disclosure. Selecting a geometry 423 with a six-sided polygonal frustum (also referred to as a hexagonal frustum) may provide one or more of the following advantages: a) Maximum Contact: More sides mean more surface area for the locking hub 420*a* to contact with the locking hub receiver section 118, 318, which could further reduce any slippage or movement during operation; b) Load Distribution: With six sides, the forces are evenly distributed, potentially providing better resistance against torque and other operational stresses; c) Standardization: Hexagonal designs are commonly used in other machine components and fasteners, potentially allowing easier integration with other systems.

Each of the geometries 423 described with respect to FIGS. 4A-4D may provide benefits suitable for different users and applications. Factors such as case of manufacturing, compatibility with existing systems, resistance to operational stresses, and even user preference may be considered when deciding which geometry is the most suitable for a given application.

Figure 5A:
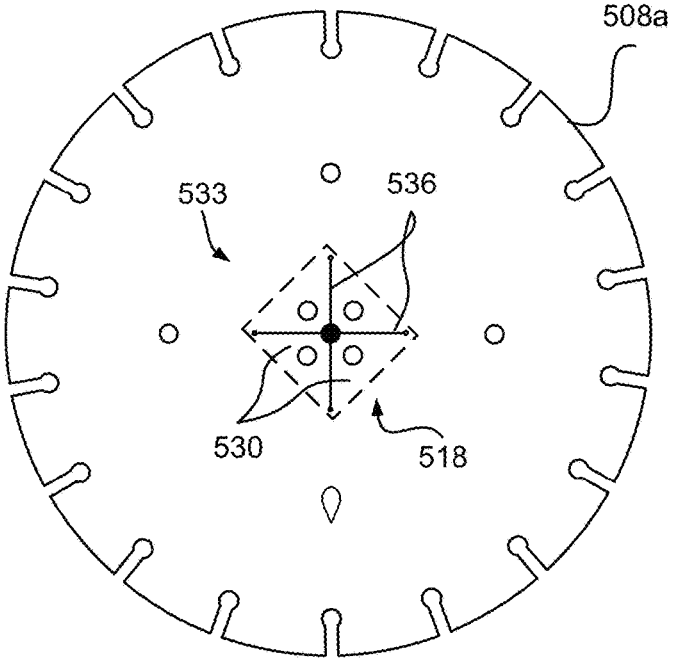
FIG. 5A depicts a manufacturing pattern for the segmented rim grinder blade of FIG. 3A, according to one or more examples of the disclosure.

FIG. 5A depicts a grinding side plan view of a manufacturing flat pattern 500*a*, 500*b* for the segmented rim grinder blade of FIG. 3A, according to one or more examples of the disclosure. In various implementations, a grinder blade for flush cutting concrete is provided by a manufacturer of diamond grinder blades. The materials used to manufacture the core of the grinder blades 108, 308*a*, 308*b* may include in various example limitations one or more of the following types of metal.

In some implementations, high-strength steel may be used due to its high tensile strength and durability. High-strength steel can withstand the torque and pressure exerted during grinding operations. In certain implementations, tungsten carbide is used based on its excellent hardness and the fact that tungsten carbide can be an excellent substrate for diamond particles. In certain implementations, aluminum alloys may be used because they are lighter than steel and carbide but it should be noted that aluminum alloys may not offer the same level of durability.

In various implementations, composite materials which are combinations of metals and ceramics may be used to form the core of the grinder blade 108, 308*a*, 308*b* to achieve a balance between weight, strength, and durability. In certain implementations, cobalt alloys which are known for their superior heat resistance, can be selected where heat resistance may provide an advantage in high-speed grinding operations. Nickel-based alloys can offer good corrosion resistance in addition to high-temperature stability.

In various implementations, the manufacturing flat pattern 500*a*, 500*b* includes patterns for a plurality of slits 536 at a center portion 533 of the grinder blade 508*a* to form a plurality of tabs 530 corresponding to a proximal tapered portion of the locking hub receiver section 518. More details about previous steps that may be used for forming the slits 536 is provided in the description with respect to FIG. 8.

Figure 5B:
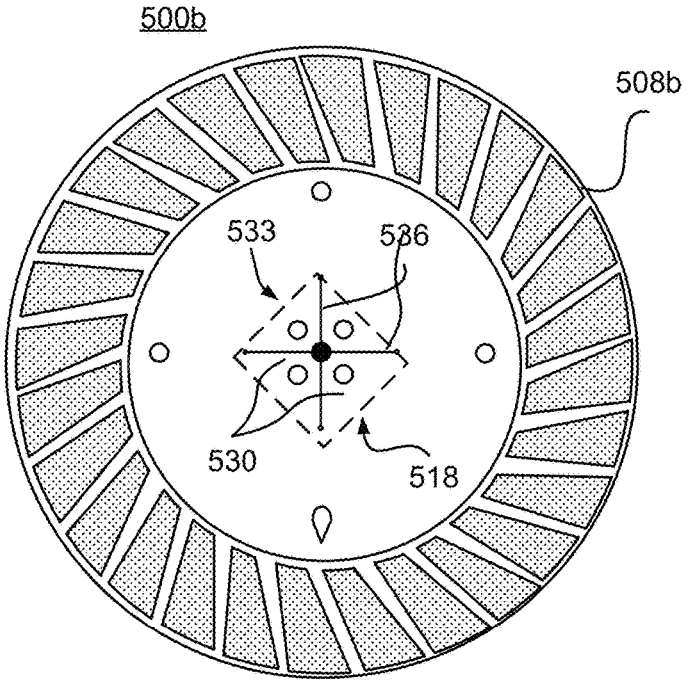
FIG. 5B depicts a manufacturing pattern for the turbo grinder blade of FIG. 3B, according to one or more examples of the disclosure.

FIG. 5B depicts a manufacturing flat pattern for the turbo grinder blade of FIG. 3B, according to one or more examples of the disclosure. As similarly described with respect to FIG. 5A, in various implementations, the manufacturing flat pattern 500*b* includes patterns for a plurality of slits 536 at a center portion 533 of the grinder blade 508*b* to form a plurality of tabs 530 corresponding to a proximal tapered portion of the locking hub receiver section 518. Likewise, more details about steps that may be used for forming the slits 536 is provided in the description with respect to FIG. 8.

Figure 6:
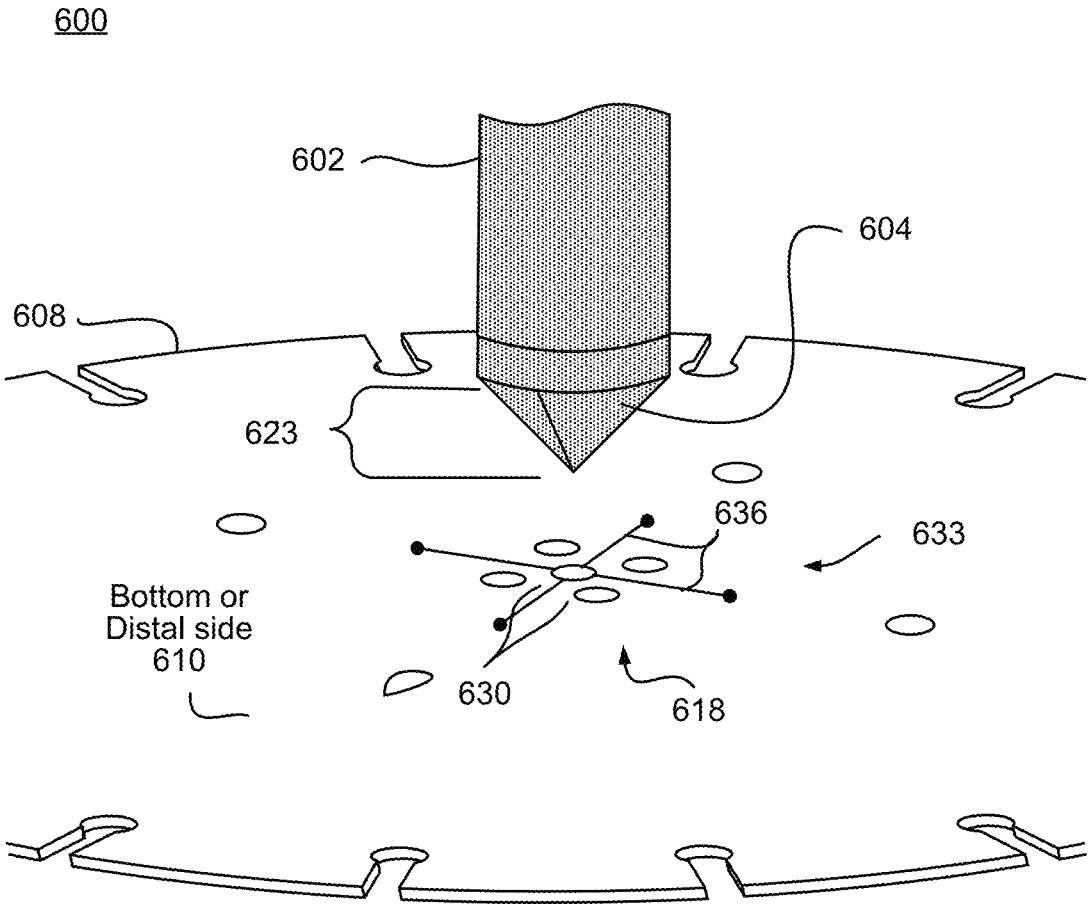
FIG. 6 depicts a perspective view of a setup for manufacturing an apparatus with a secure grinder blade and a tool-side locking hub for flush cutting concrete, in accordance with one or more examples of the disclosure.

FIG. 6 depicts a perspective view of a system 600 designed for manufacturing a secure grinder blade 608 for flush cutting concrete where a locking hub receiver section 618 is unitarily formed from the grinder blade 608 at a center portion 633 to extend in a proximal direction to receive a locking hub (e.g., such as the locking hub 120, 320) and configured to receive multiple fasteners (e.g., 122, 322) disposed proximally of a tool-side plane (e.g., 118, 318) to secure the locking hub (e.g., 120, 320) against the locking hub receiver section 618 of the grinder blade 608.

The system 600 includes a machine press 602 fitted with a die 604 shaped to match the geometry 623 of a locking hub with a selected geometry. The geometry of the die 604 substantially conforms to a geometry 123, 323, 423 of the locking hub 120, 320, 420*a*-420*d*, etc. Utilizing the die 604, the pressing process enables a set of tabs 630, predefined by slits 636 to be bent in a proximal direction at an angle designed to closely match the taper angle (e.g., 427) of the locking hub 420*a* depicted in FIG. 4A.

In the depicted example of FIG. 6, as a die 604 that has a four-sided geometry moves in a proximal direction starting from the distal side 610 of the grinder blade 608, it bends the tabs 630 at an angle consistent with the taper angle 427 of the four-sided geometry, as previously elaborated upon in FIG. 4A. However, in certain implementations, geometries with a different number of sides may also be deemed appropriate and desirable.

Figure 7:
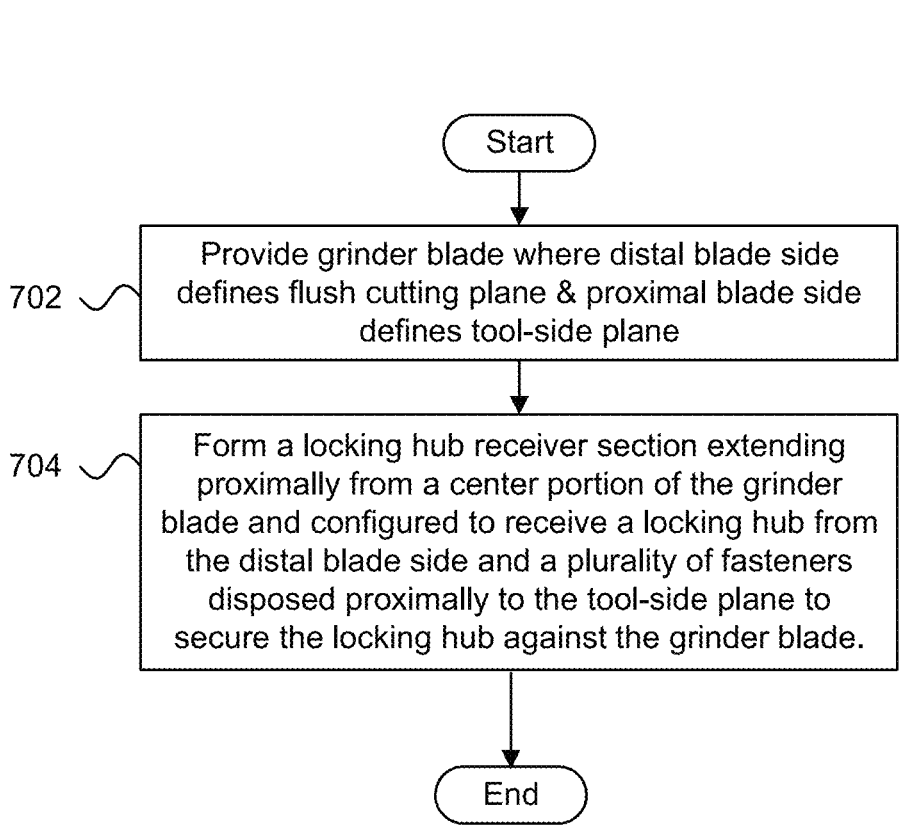
FIG. 7 depicts a schematic flow chart diagram illustrating a method for manufacturing an apparatus with a secure grinder blade and a tool-side locking hub for flush cutting concrete, in accordance with one or more examples of the disclosure.

FIG. 7 depicts a schematic flow chart diagram illustrating a method 700 for manufacturing an apparatus with a secure grinder blade and a tool-side locking hub for flush cutting concrete, in accordance with one or more examples of the disclosure.

In various implementations, the method 700 begins and includes providing 702 a grinder blade with a distal side that defines a flush cutting plane and a proximal side that defines a tool-side plane opposite the distal side. In such implementations, the method 700 continues and includes forming 704 a locking hub receiver section extending proximally from a center portion of the grinder blade and configured to receive a locking hub from the distal side and a plurality of fasteners disposed proximally to the tool-side plane to secure the locking hub against the grinder blade. In certain implementations, the method 700 ends.

Figure 8:
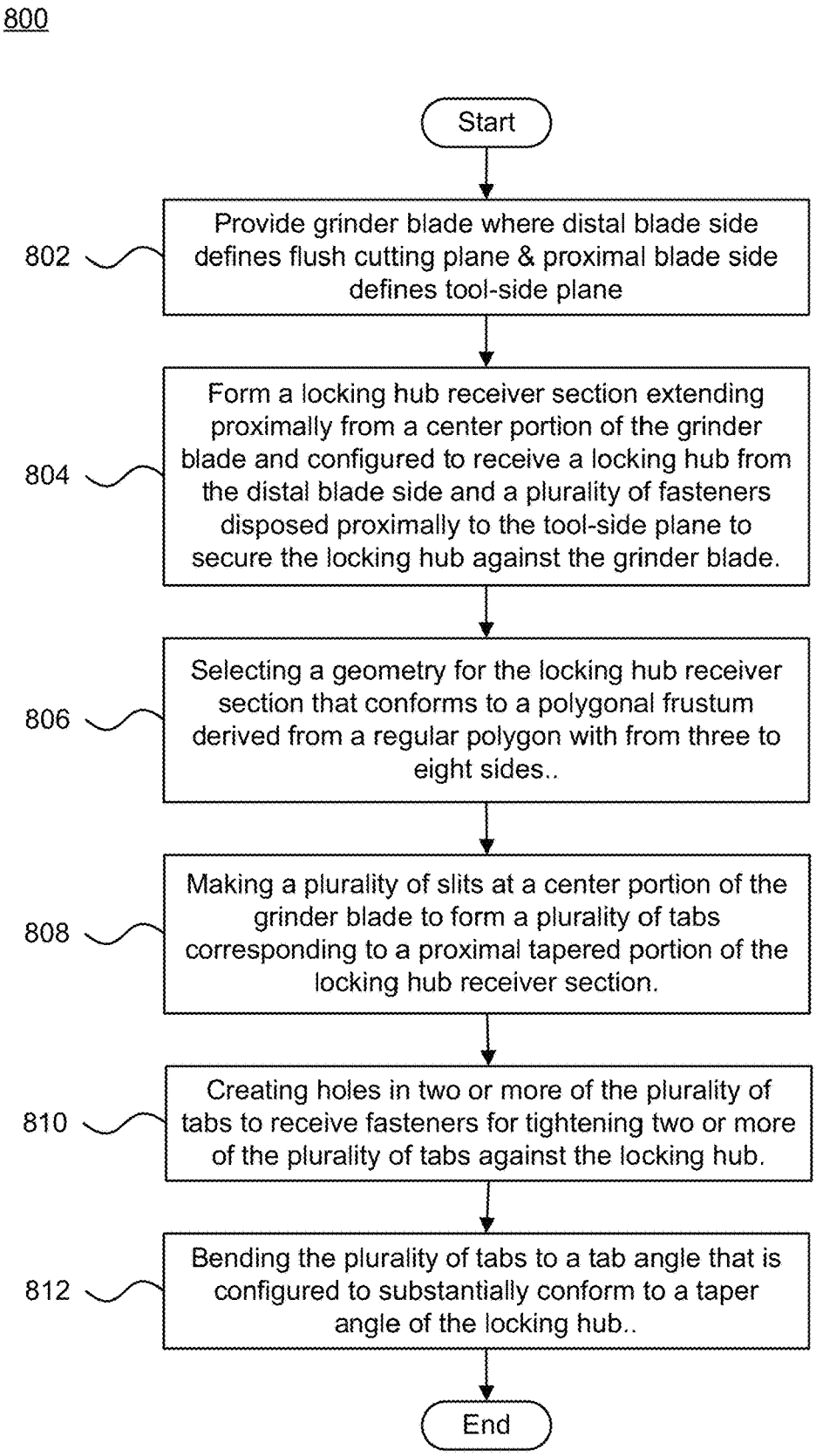
FIG. 8 depicts a schematic flow chart diagram illustrating a detailed method for manufacturing an apparatus with a secure grinder blade and a tool-side locking hub for flush cutting concrete, in accordance with one or more examples of the disclosure.

FIG. 8 depicts a schematic flow chart diagram illustrating a detailed method 800 for manufacturing an apparatus with a secure grinder blade and a tool-side locking hub for flush cutting concrete, in accordance with one or more examples of the disclosure.

In some implementations, the method 800 continues and includes providing 802 a grinder blade with a distal side that defines a flush cutting plane and a proximal side that defines a tool-side plane opposite the distal side; and forming 804 a locking hub receiver section extending proximally from a center portion of the grinder blade and configured to receive a locking hub from the distal side and a plurality of fasteners disposed proximally to the tool-side plane to secure the locking hub against the grinder blade.

In various implementations, the method 800 continues and includes selecting 806 a geometry for the locking hub receiver section that conforms to a polygonal frustum derived from a regular polygon with from three to eight sides.

In certain implementations, the method 800 continues and includes making 808 a plurality of slits at a center portion of the grinder blade to form a plurality of tabs corresponding to a proximal tapered portion of the locking hub receiver section.

In various implementations, different techniques may be used for making 808 the plurality of slits at the center portion of the grinder blade to form the plurality of tabs corresponding to the tapered portion of the locking hub receiver section. For example, in some implementations, making 808 the slits in the grinder blade may involve one or more of the following techniques: a) Laser machining offers high precision and is excellent for cutting hard materials like high-strength steel or tungsten carbide. It can produce narrow, clean slits for the tabs; chemical etching can be very precise but may be slower than mechanical or laser methods due to the hardness of the grinder blade core material; b) Electrical Discharge Machining (EDM) is another precise technique that may be used to cut slots into steel cores. It involves using an electrical discharge (or spark) to remove material from the steel. EDM is slower than laser cutting but can be more suitable for very hard materials; c) Milling involves using a rotating tool to remove material from the steel core. This is an older method and not as precise as laser cutting or EDM, but it is robust and widely used. CNC systems can control the milling machine for increased accuracy. Various other methods known by skilled artisans may be used to form the step of making 808 the slits in the grinder blade.

In some implementations, the method 800 continues and includes creating 810 holes in two or more of the plurality of tabs to receive fasteners for tightening two or more of the plurality of tabs against the locking hub. In various implementations, tools and techniques similar to those described for making 808 the slits in the grinder blade may also be used for creating 810 the holes in two or more of the plurality of tabs to receive fasteners for tightening the tabs against the locking hub. In certain implementations, the method 800 does not necessarily need to include creating a hole in every tab for tightening that specific tab to the locking hub provided that other tabs can be securely and reliably fastened with fasteners on other tabs.

In various implementations, the method 800 continues and includes bending 812 the plurality of tabs to a tab angle that is configured to substantially conform to a taper angle of the locking hub. For example, the step of bending 812 may be performed using the machine press.

In certain implementations, one or more steps of the method 800 may be performed in a different order and/or one or more steps may be omitted. Likewise, additional steps may be included in the method 800 without departing from the approach disclosed herein and set forth in the claims appended hereto.

What is claimed is:

1. An apparatus comprising:

a grinder blade with a core material comprising a hard metal or a hard metal alloy for flush cutting concrete, the grinder blade comprising:

a top side configured to face a grinder to which the grinder blade is attached;

an outer edge operable to enable the grinder blade to make a perpendicular cut into a surface of a first section of concrete up to a radial depth of the grinder blade that is proximate to a locking hub receiver section on the top side of the grinder blade, wherein the perpendicular cut is perpendicular relative to the surface of the first section of concrete;

a bottom side opposite of the top side and configured to make flush contact with a second section of concrete that is perpendicularly adjoined to the first section of concrete concurrently with the outer edge making a perpendicular cut into the first section of concrete; and the locking hub receiver section being unitarily formed from a center portion of the grinder blade and extending from the top side of the grinder blade in a direction toward the grinder to which the grinder blade attaches, the locking hub receiver section configured to receive a locking hub and comprising a plurality of fastener holes configured to align with threaded fastener engaging bores in a plurality of tapered side portions of the locking hub for receiving a plurality of threaded fasteners from the top side of the grinder blade to tighten the locking hub against the grinder blade.

2. The apparatus of claim 1, further comprising the locking hub, wherein the locking hub comprises:

a solid geometric form that substantially conforms to the locking hub receiver section and comprises a base, a top surface that is smaller in perimeter than the base and is parallel to the base, and the plurality of tapered side portions being angled at an acute angle relative to the base and converging towards the top surface;

a spindle engaging bore extending perpendicularly into the top surface of the locking hub and configured to engage with a spindle of the grinder to which the grinder blade is configured to attach; and two or more threaded fastener engaging bores extending into the tapered side portions of the locking hub that are configured to be tightened against the locking hub receiver section of the grinder blade by tightening heads of the plurality of threaded fasteners from the top side of the grinder blade.

3. The apparatus of claim 2, wherein the plurality of threaded fasteners comprise non-countersunk machine screws.

4. The apparatus of claim 3, wherein the heads of the plurality of threaded fasteners are selected from star drive, square drive, Phillips drive, and hex drive.

5. The apparatus of claim 2, wherein the locking hub receiver section comprises a plurality of tabs that are unitarily formed from the grinder blade at the center portion and angled at the acute angle relative to the top side of the grinder blade at the center portion.

6. The apparatus of claim 5, further comprising one or more fastener holes in the plurality of tabs through which the plurality of threaded fasteners pass and are tightened from the top side of tab forming portions of the grinder blade to secure one or more tabs of the locking hub receiver section against the locking hub.

7. The apparatus of claim 5, wherein a geometry of the locking hub comprises a polygonal frustum with from three to eight sides.

8. The apparatus of claim 7, wherein the locking hub comprises a locking hub base for the polygonal frustum wherein the locking hub base comprises a non-tapered polygonal extrusion extending from a bottom portion of the polygonal frustum.

9. The apparatus of claim 7, wherein the geometry of the locking hub comprises a four-sided frustum.

10. The apparatus of claim 8, wherein one or more tapered side portions of the polygonal frustum converge toward to the top surface of the frustum at an acute angle of from 20 degrees to 70 relative to a plane defined by a bottom surface of the locking hub base.

11. The apparatus of claim 2, wherein the grinder blade comprises one or more cutting surfaces at an outer perimeter comprising diamond particles.

12. The apparatus of claim 11, wherein the grinder blade comprises a segmented rim.

13. The apparatus of claim 2, wherein the grinder blade comprises a plurality of diamond grinding regions.

14. The apparatus of claim 13, wherein the plurality of diamond grinding regions are diamond segments angled in a turbo pattern.

15. A system comprising:

a grinder;

a grinder blade with a core material comprising a hard metal or a hard metal alloy for flush cutting concrete, the grinder blade further comprising:

a top side configured to face the grinder to which the grinder blade is configured to attach;

an outer edge operable to enable the grinder blade to make a perpendicular cut into a surface of a first section of concrete up to a radial depth of the grinder blade that is proximate to a locking hub receiver section on the top side of the grinder blade, wherein the perpendicular cut is perpendicular relative to the surface of the first section of concrete;

a bottom side opposite of the top side, and configured to make flush contact with a section of concrete that is perpendicularly adjoined to the first section of concrete concurrently with the outer edge perpendicularly cutting into the first section of concrete; and the locking hub receiver section being unitarily formed from the grinder blade at a center portion and angled toward the grinder to which the grinder blade attaches to receive a locking hub and comprising a plurality of holes configured to allow a plurality of fasteners to be inserted from the top side of the grinder blade and tightened by heads of a plurality of threaded fasteners from the top side of the grinder blade to secure the locking hub against the grinder blade:

the locking hub comprising:

a solid geometric form that substantially conforms to the locking hub receiver section and comprises one or more angled top side portions extending between a top planar surface of the solid geometric form and a top intersection with a corresponding base;

a spindle engaging bore extending perpendicularly into the top planar surface of the locking hub configured to engage with a spindle of the grinder to which the grinder blade is configured to attach; and two or more threaded fastener engaging bores extending into tapered side portions of the locking hub that are configured to be tightened against the locking hub receiver section of the grinder blade by tightening heads of the plurality of threaded fasteners from the top side of the grinder blade.

* * * * *